US009295224B2

(12) United States Patent
Arden et al.

(10) Patent No.: US 9,295,224 B2
(45) Date of Patent: Mar. 29, 2016

(54) FREESTANDING FORCE PROTECTION SYSTEM

(71) Applicant: ArdenX LLC, Miami, FL (US)

(72) Inventors: Dennis Arden, Claremore, OK (US); H. Baird Lobree, Miami, FL (US)

(73) Assignee: ArdenX LLC, Miami, FL (US)

( * ) Notice: Subject to any disclaimer, the term of this patent is extended or adjusted under 35 U.S.C. 154(b) by 25 days.

(21) Appl. No.: 14/036,889

(22) Filed: Sep. 25, 2013

(65) Prior Publication Data

US 2014/0291595 A1 Oct. 2, 2014

Related U.S. Application Data

(63) Continuation-in-part of application No. 12/835,421, filed on Jul. 13, 2010, now Pat. No. 8,573,566, which is a continuation-in-part of application No. 11/713,052, filed on Mar. 1, 2007, now Pat. No. 7,753,346.

(51) Int. Cl.

| | |
|---|---|
| ***E04H 17/14*** | (2006.01) |
| ***A01K 3/00*** | (2006.01) |
| ***E04H 17/06*** | (2006.01) |
| ***E02B 3/10*** | (2006.01) |

(52) U.S. Cl.

CPC . *A01K 3/005* (2013.01); *A01K 3/00* (2013.01); *E02B 3/108* (2013.01); *E04H 17/06* (2013.01)

(58) Field of Classification Search

CPC ..... A01K 3/00; A01K 3/005; E02B 3/108; E04H 17/06

USPC ..... 256/19, 35, DIG. 5; 404/6, 9; 52/424–426; 405/16, 21, 29, 35, 107, 405/110, 111, 115; 249/117

See application file for complete search history.

(56) References Cited

U.S. PATENT DOCUMENTS

| | | | | |
|---|---|---|---|---|
| 86,133 | A | 1/1869 | Calkins | |
| 267,523 | A * | 11/1882 | Harris | 256/19 |
| 269,625 | A * | 12/1882 | Blake | 248/98 |
| 293,342 | A | 2/1884 | Messenger | |
| 310,555 | A | 1/1885 | Brevoort | |
| 338,892 | A * | 3/1886 | Walker | 220/9.3 |

(Continued)

FOREIGN PATENT DOCUMENTS

| | | | |
|---|---|---|---|
| EP | 1199509 | A2 | 4/2002 |
| JP | 02004300742 | A | 10/2004 |

*Primary Examiner* — Gregory Binda
*Assistant Examiner* — Nahid Amiri
(74) *Attorney, Agent, or Firm* — Molly D. McKay

(57) ABSTRACT

A portable barrier wall used for preventing the passage of people, vehicles, projectiles, blast debris, liquids, wind or waves through the wall. The wall is constructed of one or more x-shaped freestanding support structures arranged in parallel orientation to form a frame for holding retaining members that attach to the support structures. The retaining members form U-shaped containment structures within each segment of the wall. Fill material is added to the containment structures which are then sealed. Connecting means attach the two support structures together to prevent movement. Wall used to contain liquids may additionally include a liquid impervious layer that is placed external to the retaining member on the side of the barrier wall that will be in contact with liquid and the layer is anchored under the feet of one of the support structures. The wall may additionally hold absorptive or adsorptive materials to contain spills and contaminants.

6 Claims, 14 Drawing Sheets

(56) References Cited

U.S. PATENT DOCUMENTS

| | | | | | |
|---|---|---|---|---|---|
| 344,413 | A | * | 6/1886 | Shedd | 256/63 |
| 380,529 | A | | 4/1888 | Shelley | |
| 381,047 | A | | 4/1888 | Wood | |
| 393,168 | A | | 11/1888 | Maxam | |
| 406,642 | A | | 7/1889 | Frost | |
| 673,997 | A | | 5/1901 | Chapman | |
| 674,204 | A | * | 5/1901 | Grant | 256/63 |
| 700,076 | A | * | 5/1902 | Patent | 405/107 |
| 801,942 | A | | 10/1905 | Warner et al. | |
| 1,838,151 | A | | 12/1931 | Penote | |
| 2,805,277 | A | | 9/1957 | Moeller | |
| 2,855,183 | A | | 10/1958 | Moore | |
| 3,222,019 | A | * | 12/1965 | Weisberg | 248/97 |
| 3,767,167 | A | | 10/1973 | Rasmussen | |
| 3,910,560 | A | | 10/1975 | Goetz | |
| 3,921,585 | A | | 11/1975 | Hall | |
| 4,145,030 | A | | 3/1979 | Ingraham | |
| 4,145,031 | A | | 3/1979 | Baker, II | |
| 4,172,427 | A | | 10/1979 | Kindred | |
| 4,267,996 | A | * | 5/1981 | Turcott | 248/97 |
| 4,339,114 | A | | 7/1982 | Deike | |
| 4,576,509 | A | * | 3/1986 | Beaty, Sr. | 404/6 |
| 4,643,271 | A | * | 2/1987 | Coburn | 181/210 |
| 4,682,761 | A | | 7/1987 | Hanneken | |
| 4,763,879 | A | | 8/1988 | Wasicek et al. | |
| 4,860,996 | A | | 8/1989 | Robbins | |
| 4,889,322 | A | | 12/1989 | Wagner | |
| 5,063,876 | A | | 11/1991 | Harris | |
| 5,150,484 | A | | 9/1992 | Whitten, Jr. | |
| 5,301,910 | A | | 4/1994 | Lang et al. | |
| 5,302,945 | A | * | 4/1994 | Stoltenberg | 340/660 |
| 5,318,258 | A | | 6/1994 | Lang | |
| 5,593,143 | A | | 1/1997 | Ferrarin | |
| 5,722,642 | A | | 3/1998 | Bradshaw | |
| 5,732,527 | A | | 3/1998 | Schneider | |
| 5,738,342 | A | | 4/1998 | Van Winkle | |
| 5,930,932 | A | | 8/1999 | Peterson | |
| 5,961,242 | A | | 10/1999 | Leone | |
| 6,126,147 | A | | 10/2000 | Fingerson et al. | |
| 6,257,559 | B1 | | 7/2001 | Mouri | |
| 6,315,495 | B1 | * | 11/2001 | Starheim | 405/129.8 |
| 6,579,034 | B1 | * | 6/2003 | Welch et al. | 404/6 |
| 6,745,414 | B2 | | 6/2004 | Zhou | |
| 6,802,496 | B1 | | 10/2004 | Preta | |
| 6,866,252 | B2 | | 3/2005 | Pulliam | |
| 6,997,977 | B2 | * | 2/2006 | Dallas et al. | 96/153 |
| 7,048,474 | B2 | | 5/2006 | Tabler | |
| 7,753,346 | B2 | | 7/2010 | Arden | |
| 8,215,864 | B2 | * | 7/2012 | Kennedy et al. | 404/6 |
| 8,425,158 | B2 | * | 4/2013 | Milton et al. | 405/302.7 |
| 2001/0002968 | A1 | * | 6/2001 | Black | 405/36 |
| 2004/0098817 | A1 | * | 5/2004 | Reese | 14/27 |
| 2006/0013651 | A1 | * | 1/2006 | Williams et al. | 404/6 |
| 2009/0149690 | A1 | * | 6/2009 | Chick | 588/249 |
| 2009/0250675 | A1 | * | 10/2009 | Cashin et al. | 256/13.1 |

* cited by examiner

FREESTANDING FORCE PROTECTION SYSTEM

CROSS-REFERENCE TO RELATED APPLICATIONS

The present application is a continuation in part application of U.S. patent application Ser. No. 12/835,421 filed on Jul. 13, 2010 for the invention entitled FREESTANDING FENCE SYSTEM which in turn is a continuation in part of U.S. patent application Ser. No. 11/713,052 filed on Mar. 1, 2007 for the invention entitled FREESTANDING FENCE.

BACKGROUND OF THE INVENTION

1. Field of the Invention

The invention relates to a freestanding force protection system that is supported on footed x-shaped posts. A horizontal member extends between adjacent x-shaped posts and a footed vertical support member can be installed on each horizontal member approximately midway between the adjacent x-shaped posts to provide additional support. Several wires or crash-rated safety cables extend horizontally and connect adjacent x-shaped posts along the length of the supporting structure. The horizontal members attach to the x-shaped posts with universal joints in the form of couplings that allow for both vertical and horizontal adjustment that allow the horizontal member to attach to the x-shaped posts at virtually any angle.

The improvement in the freestanding force protection system is the use of at least one freestanding structure arranged in parallel orientation with the addition of a retaining member filled with desired material located between the parallel structures such that the combination becomes a barrier for passage of various things, including but not limited to people, vehicles, projectiles, blast debris, water, wind, waves, etc. through the resulting force protection structure, thereby creating a retaining wall 200 that can be used as a perimeter security wall 200, a blast wall 200, a flood wall 200, etc.

2. Description of the Related Art

It is often desirable to construct a freestanding force protection system that can later be moved and reused in a different location and used in a different configuration. Also, it would be desirable if the materials used to construct the freestanding force protection structure where pieces that were easily transported using a truck or trailer and could be assembled and disassembled using a few simple tools.

The invention addresses these needs by providing a freestanding force protection system that does not require the digging of post holes and installing posts in the ground. Further the invention is constructed of readily available square tubing and a few connectors that attach together to construct a freestanding force protection system that can be made in almost any configuration and installed on almost any terrain. Because the invention is constructed in pieces, it can be disassembled, moved, reconfigured and reassembled multiple times without damage to the pieces.

Further, the freestanding force protection system is not as likely to serve as a ground for lightening strikes as would a fixture that had posts buried in the ground. This is particularly true when the feet of the invention are pretreated with a non-conductive plastic, rubber coating, or pads.

Still further, with only slight modification, the horizontal members of the freestanding force protection system can be used as a conduit for water so that the freestanding force protection system can additionally be used as a water or chemical sprinkler. And the horizontal members can be used as a conduit for security system wiring, lighting, communications, fiber optics, electrical wiring, cameras, environmental and identification monitoring devices, solar panels, radio frequency identification devices, sensors, etc.

Also, the freestanding force protection system is structurally strong so that it can be used to mount additional equipment on the freestanding force protection system, such as for example, environmental monitoring and identification management devices, lighting, alarm systems, communication or transmission antennas and devices, cameras, infrared and motion detection equipment, radio frequency identification equipment, fiber optics, solar panels, sensors, crash-rated safety cables, etc.

Because of the unique features of this freestanding force protection system and the easy and speed with which it can be constructed and deconstructed, the uses for the force protection system are numerous. These uses may include military, law enforcement, petroleum, chemical, electrical, utility, pipeline, industrial, government erosion control, border control, mining, expeditionary, agriculture, etc.

Further, it is desirable to have a retaining wall that can be constructed quickly, but that is strong and can prevent the passage of people, vehicles, projectiles, blast debris, water, wind, waves, etc. through the wall.

The invention addresses this problem by providing at least one freestanding structure that are constructed in accordance with the invention and that are arranged in parallel orientation. Then a retaining member is installed between the two parallel structures and a desired material is placed within the retaining member such that the combination becomes a barrier for passage of various things through the resulting structure. The resulting structure is a retaining wall that can be used as a perimeter security wall, a blast wall, a flood wall, erosion control, etc. The desired material that is placed within the retaining member is chosen specifically for the desired use for the retaining wall. Examples of materials that may be used within the retaining wall are sand, dirt, rock, other absorptive and adsorptive materials, etc.

SUMMARY OF THE INVENTION

The invention is a freestanding structure that is supported by x-shaped posts. Each leg of the x-shaped posts has a post foot on its lower end on which the post rests upon the top of the ground. A horizontal member extends between adjacent x-shaped posts and a vertical support member can be installed on each horizontal member approximately midway between the adjacent x-shaped posts. Each vertical support member has a member foot on its lower end on which the vertical support member rests upon the top of the ground.

Several wires or crash-rated safety cables extend horizontally and connect adjacent x-shaped posts along the length of the structure. The wires or cables are attached to the posts with a combination of traditional electrical insulators and with non-conductive wire fasteners so that the wires or cables can be connected to an appropriate electrical source to convert the structure into an electric barrier. The horizontal members can be used as a conduit or structure for network cabling conduits, lighting systems, cameras, radio frequency identification systems, solar panels, watering systems, monitors, sensors or security systems with only slight modifications to the tubing from which the horizontal members are constructed. And the x-shaped posts can be employed to support a water or chemical hose in the upwardly extending valley of the posts by simply laying a hose on top of the posts.

The horizontal members are attached to the posts by means of universal joints in the form of couplings that allow for both vertical and horizontal adjustment thereby allowing the structure to be arranged in straight, irregular, or curved arrangements when viewed from above and can be used on hilly, snowy, icy, swampy, sandy, or rough outdoor or indoor terrain where it would be difficult to install traditional posts in the ground.

The freestanding force protection system is constructed of easily assembled pieces which require only the use of a couple of wrenches to assemble. This allows an owner to easily transport the materials needed to construct the force protection system in the back of a truck or trailer. And because the structure is constructed in pieces, it can be disassembled, moved, and then reassembled as often as needed.

An alternate embodiment of the invention employs alternate welded x-shaped posts instead of the x-shaped posts made with x-shaped connectors. The two tubes forming the alternate x-shaped posts or x-posts are welded or otherwise secured together at approximately a 55 degree angle. This angle provides maximum stability although the angle can be varied somewhat. The legs of the alternate x-shaped posts are provided with adjustable feet, and receivers for receiving wires therein are secured, preferably by welding, along the length of each tube. Also, a pair of ears is secured to the sides of each tube, preferably by welding and to which the universal joints secure as a means of securing the horizontal members to the alternate x-shaped posts, as previously described.

The improvement in the freestanding force protection system is the use of at least one freestanding structure arranged in parallel orientation with the addition of a retaining member between the parallel structures and adding a desired material within the retaining member such that the combination becomes a barrier wall. The barrier wall thus formed can be used to prevent the passage of various things through the barrier wall. For example, the barrier wall can be used as a perimeter security wall, a blast wall, or a flood wall to prevent the passage of people, vehicles, projectiles, blast debris, water, wind, waves, etc.

DETAILED DESCRIPTION OF THE PREFERRED EMBODIMENT

Figure 1:
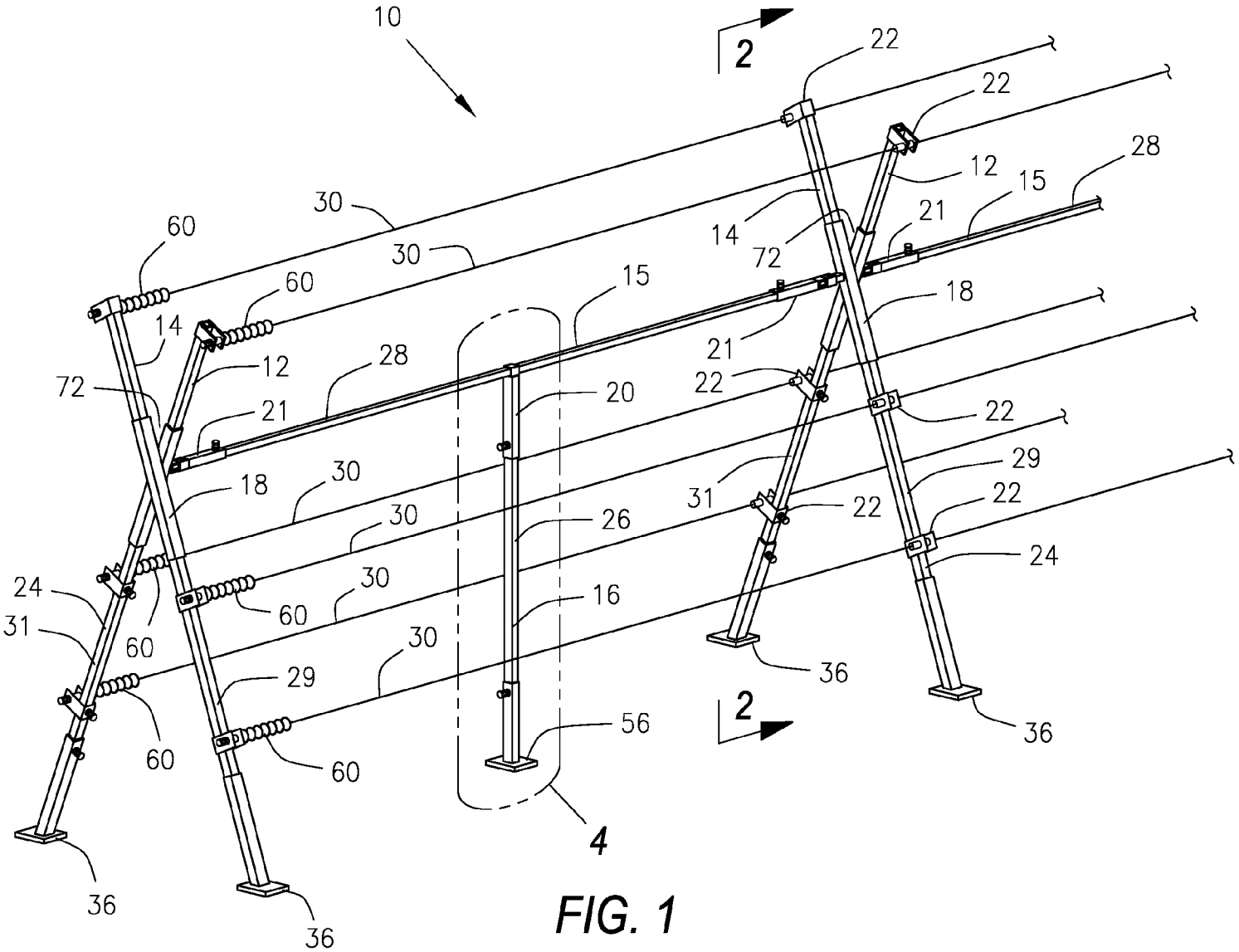
FIG. 1 is a perspective view of a freestanding structure of the invention.

Referring now to drawings and initially to FIG. 1, there is illustrated a freestanding structure 10 constructed in accordance with the invention. The structure 10 is generally constructed of pieces of square tubing 12, 14, 15, and 16 connected together by means of two types of connectors 18, 20, one type of coupling 21, and one type of fastener 22 to form vertically oriented x-shaped posts 24 and support members 26 that are connected together by horizontal members 28 and wire 30, as will be more fully described hereafter.

Figure 3:
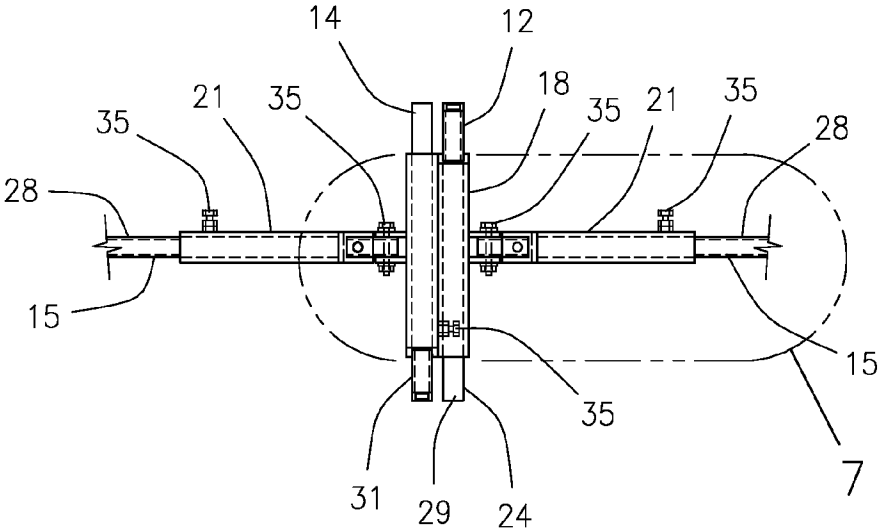
FIG. 3 is a side view taken along line 3-3 of FIG. 2.
Figure 2:
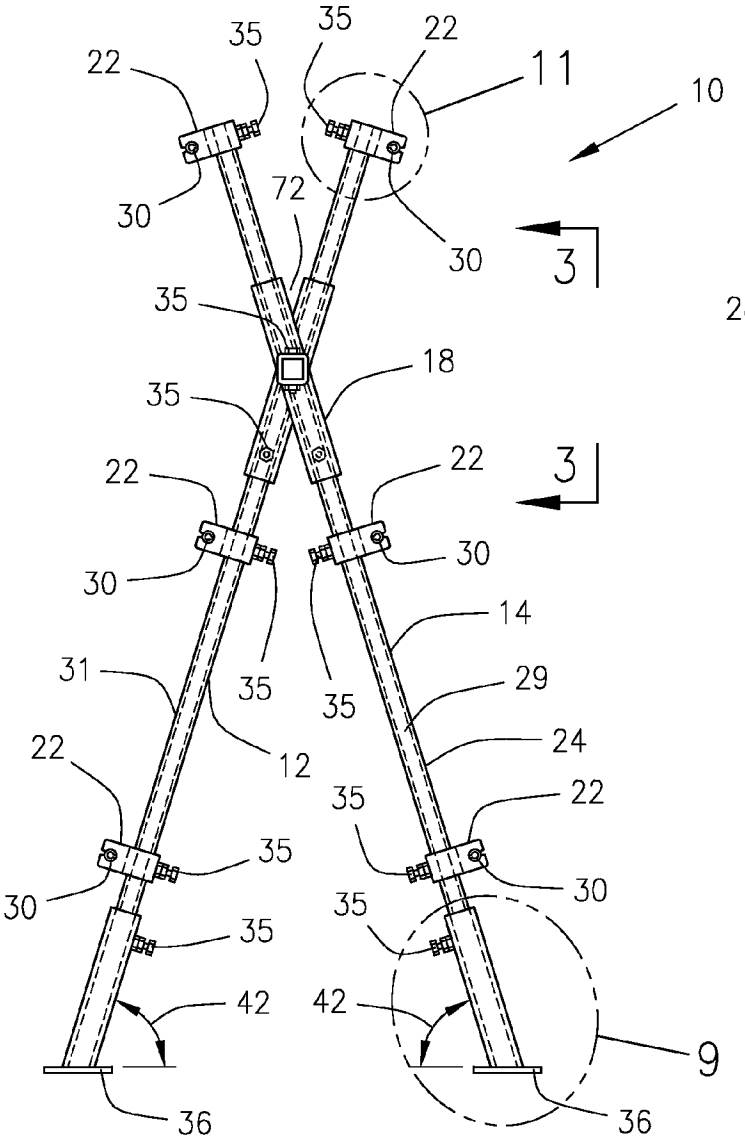
FIG. 2 is an end view taken along line 2-2 of FIG. 1.
Figure 6:
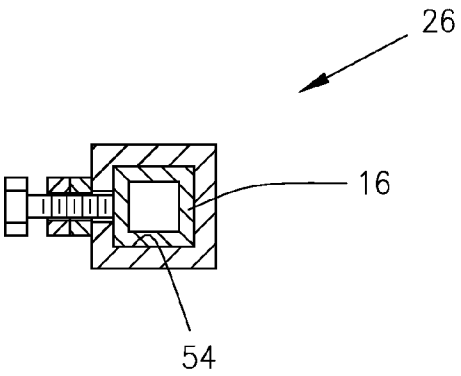
FIG. 6 is an enlarged cross sectional view taken along line 6-6 of FIG. 4.
Figure 7:
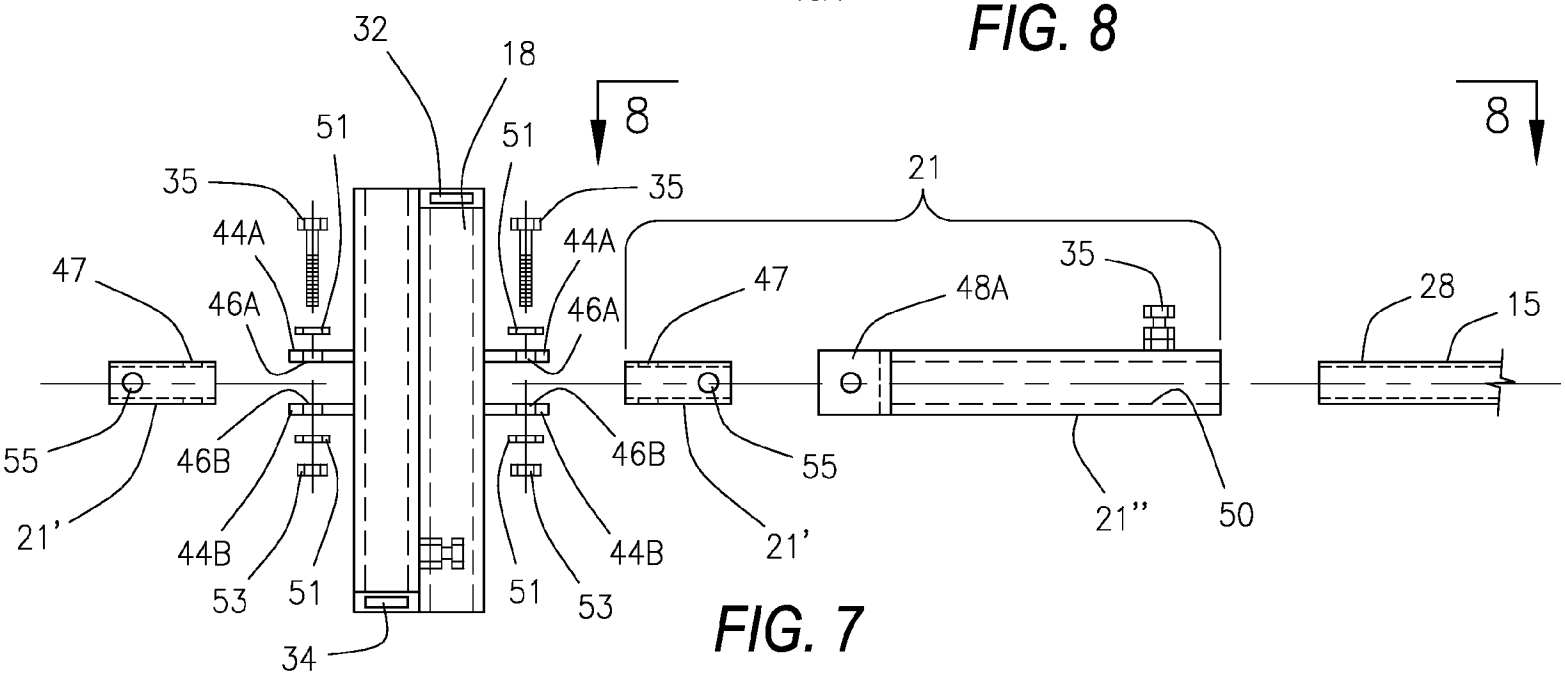
FIG. 7 is an enlarged side view of the coupling shown within the circled area associated with numeral 7 of FIG. 3.

As best seen in FIGS. 2 and 3, each x-shaped post 24 is constructed of two pieces of square tubing 12 and 14 that are held together in a criss-cross orientation by a hollow x-shaped connector 18 so that the two pieces of square tubing 12 and 14 form the two legs 29 and 31 of the x-shaped posts 24. As shown in FIG. 7, each x-shaped connector 18 is provided with a pair of hollow sleeves 32 and 34 for receiving the two pieces of square tubing 12 and 14. A threaded bolt 35 extends through the wall of each sleeve 32 and 34 of the connector 18 to engage its associated piece of square tubing 12 or 14 as a means of securing the square tubing 12 or 14 within the x-shaped connector 18 and thus securing the two legs 29 and 31 of the x-shaped post 24 together.

Figure 9:
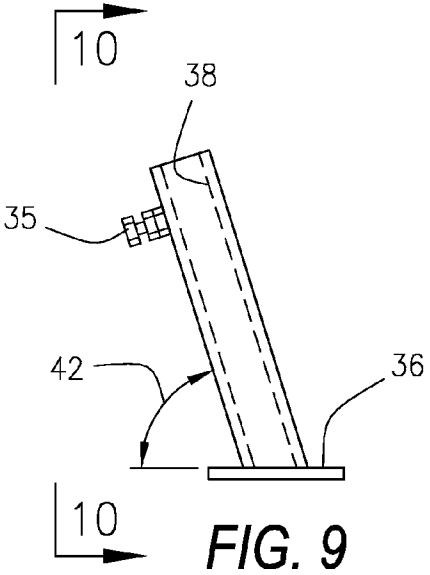
FIG. 9 is an enlarged end view of the post foot shown within the circled area associated with numeral 9 in FIG. 2.
Figure 10:
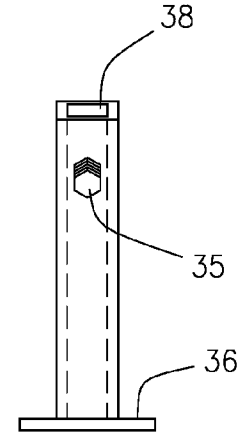
FIG. 10 is a side view of the post foot taken along line 10-10 of FIG. 9.
Figure 13:
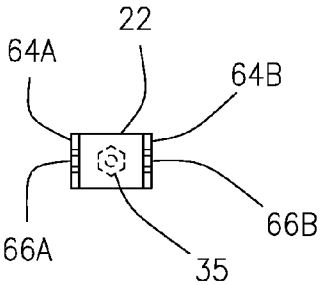
FIG. 13 is a side view taken along line 13-13 of FIG. 11.
Figure 11:
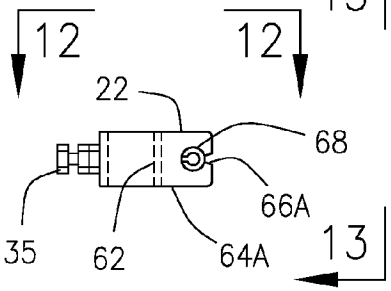
FIG. 11 is an enlarged end view of a non-conductive wire or cable fastener shown within the circled area associated with numeral 11 in FIG. 2.
Figure 12:
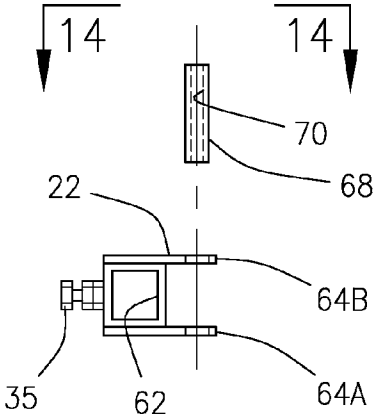
FIG. 12 is an exploded top plan view taken along line 12-12 of FIG. 11.
Figure 14:
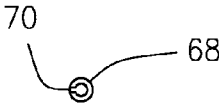
FIG. 14 is an end view of the non-conductive sleeve of the wire or cable fastener taken along line 14-14 of FIG. 12.

Referring to FIGS. 2 and 9, each leg 29 and 31 of an x-shaped post 24 has a post foot 36 secured on its lower end. Each post foot 36 is provided with a hollow sleeve 38 and the lower end of the leg 29 or 31 is received within the hollow sleeve 38 and secured therein by means of another threaded bolt 35 that extends through the wall of the sleeve 38 to engage its associated leg 29 or 31. The posts 24 rest on their post feet 36 upon the top of the ground. As shown in the FIGS. 2 and 9, the post feet 36 on the x-shaped posts 24 are at an acute angle 42 relative to the legs 29 and 31 of the posts 24 so that the post feet 36 will lay flat on the ground. This is necessary since the legs 29 and 31 of the x-shaped posts 24 are oriented at an acute angle 42 to the ground in the completed structure 10.

Figure 8:
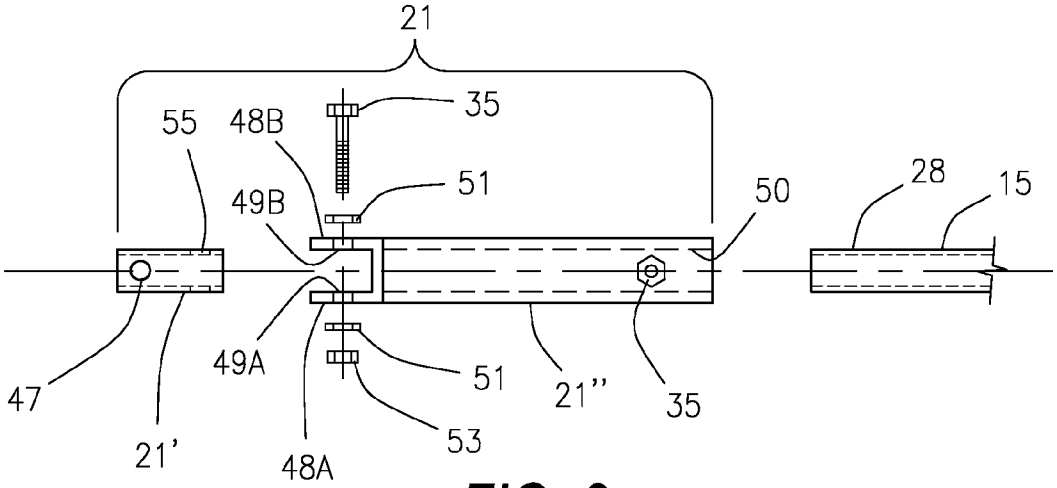
FIG. 8 is a top plan view taken along line 8-8 of FIG. 7.

As illustrated in FIG. 7, the x-shaped connector 18 is provided with a pair of ears 44A and 44B on either end of the connector 18. The ears 44A and 44B of each pair are provided with bolt openings 46A and 46B there through which align vertically with a first bolt opening 47 provided in a first portion 21' of the coupling 21 and receive a threaded bolt 35 there through as a means of securing a first portion 21' of a coupling 21 to the x-shaped posts 24. The bolt 35 is held in place by washers 51 and a nut 53. As shown in FIG. 8, the first portion 21' of the coupling 21 attaches on an opposite end to another pair of ears 48A and 48B provided on a second portion 21" of the coupling 21 that are oriented at 90 degrees from the pair of ears 44A and 44B provided on the x-shaped connector 18. The second pair of ears 48A and 48B are also provided with a pair of bolt openings 49A and 49B there through which align horizontally with a second bolt opening 55 provided in the first portion 21' of the coupling 21 and receive a threaded bolt 35 there through as a means of securing the first and second portions 21' and 21" of the coupling 21 together. The threaded bolt 35 is held in place with washers 51 and a nut 53.

By the ears 44A and 44B being oriented 90 degrees from the ears 48A and 48B, the coupling 21 allows for both vertical and horizontal adjustment of the angle of attachment of the horizontal members 28 to the x-shaped posts 24. An opposite end of the second portion 21" of the coupling 21 is provided with a hollow sleeve 50 designed to receive therein one end of the piece of square tubing 15 that forms the horizontal member 28. The square tubing 15 of the horizontal member 28 is secured within the hollow sleeve 50 of the second portion 21" of the coupling 21 by means of a threaded bolt 35 that extends through the wall of the second portion 21" of the coupling 21 to engage the square tubing 15 of the horizontal member 28. Additional horizontal members 28 extend between adjacent x-shaped posts 24 and are likewise secured on their opposite ends to the x-shaped posts 24 by additional couplings 21 and x-shaped connectors 18.

Figure 15:
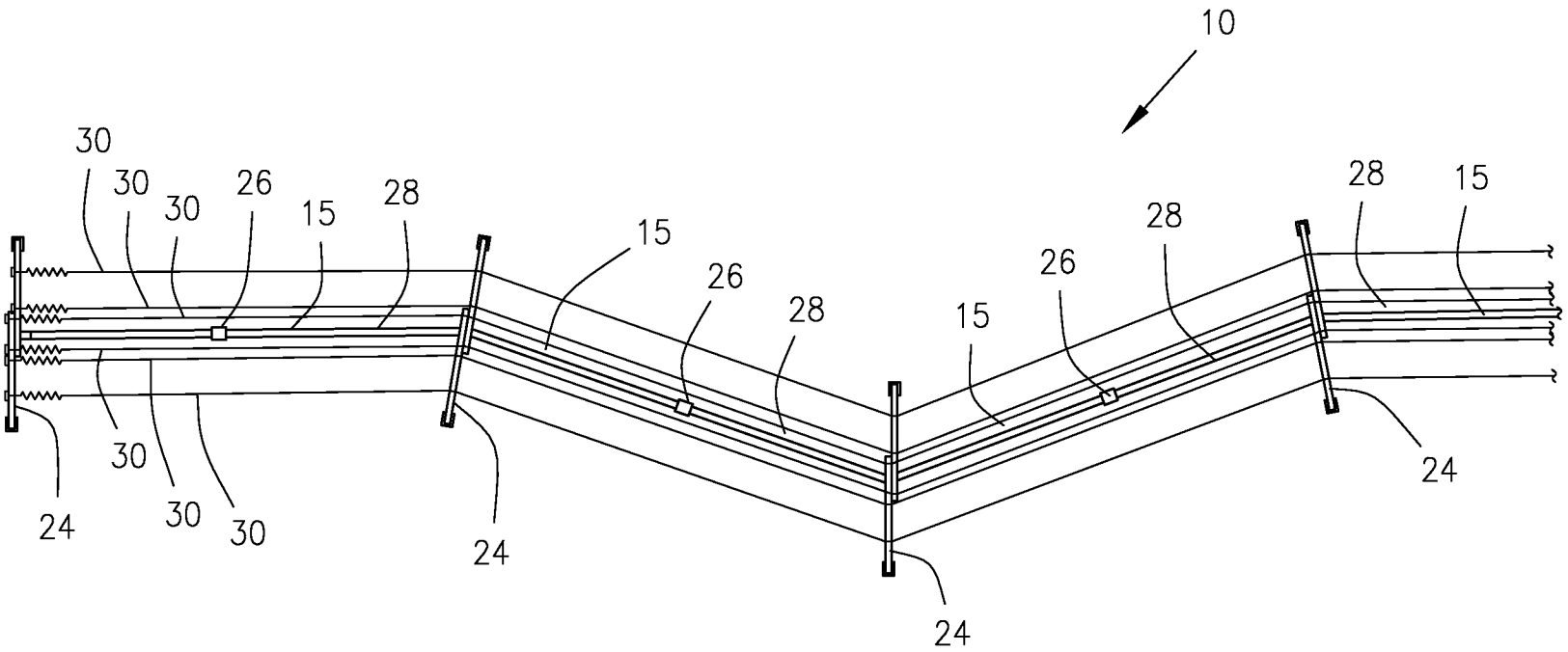
FIG. 15 is a top view of a freestanding structure constructed in accordance with the invention illustrating that the structure can be constructed with odd angles and curves.

Because the couplings 21 that connect the horizontal members 28 to the posts 24 allow for horizontal adjustment, this enables the structure 10 to be arranged in straight, irregular, or curved arrangements when viewed from above, as illustrated in FIG. 15. And because the couplings 21 that connect the horizontal members 28 to the posts 24 also allow for vertical adjustment, this enables the structure 10 to be used on hilly, rocky, swampy, sandy, icy, snowy, or rough outdoor or indoor terrain where it would be difficult to install traditional posts in the ground.

Referring to FIGS. 1, 4, 5, and 6, a vertical support member 26 can be installed on each horizontal member 28 approximately midway between the adjacent x-shaped posts 24 to provide additional support. The vertical support member 26 has a top connector 20 that has a first hollow sleeve 52 for receiving there through the piece of square tubing 15 that forms the horizontal member 28. The top connector 20 is also provided with a second hollow sleeve 54 at approximately a 90 degree angle from the first sleeve 52 for receiving the piece of square tubing 16 that forms the vertical support member 26. The square tubing 16 is secured within the second sleeve 54 by means of a threaded bolt 35 that extends through the wall of the second sleeve 54 to engage the square tubing 16 of the vertical support member 26.

Figure 4:
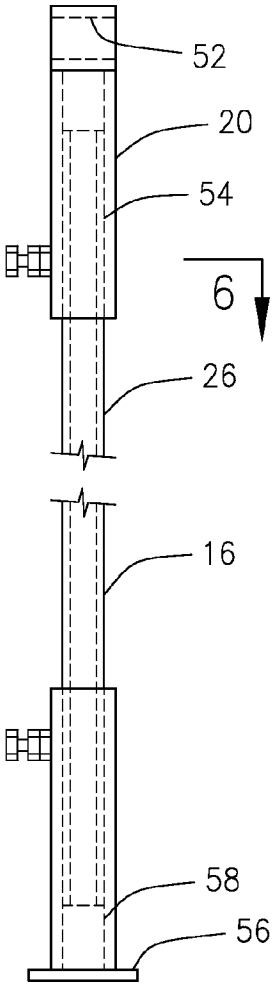
FIG. 4 is an enlarged side view of a vertical support member shown within the circled area associated with numeral 4 of FIG. 1.
Figure 5:
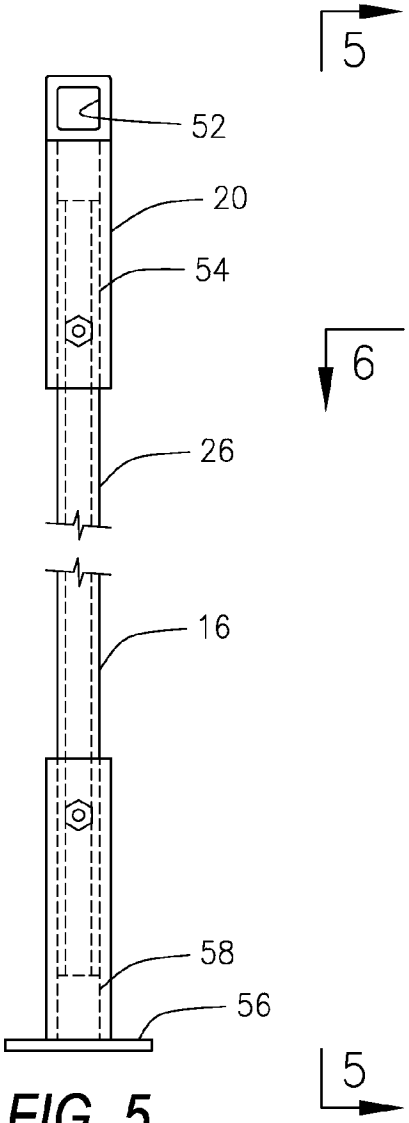
FIG. 5 is an end view taken along line 5-5 of FIG. 4.

Each vertical support member 26 has a member foot 56 on its lower end on which the vertical support member 26 rests upon the top of the ground. Each member foot 56 has a hollow sleeve 58 for receiving the lower end of the square tubing 16 that forms the vertical support member 26, and the square tubing 16 is secured within the sleeve 58 of its associated member foot 56 by means of a threaded bolt 35 that extends through the wall of the member foot's sleeve 58 and engages the square tubing 16. As shown in FIGS. 1, 4 and 5, the member 56 provided on the vertical support members 26 are preferably at approximately a 90 degree angle relative to their associated vertical support members 26 so that the member feet 56 rest on the ground and hold the vertical support members 26 vertically above the ground.

Referring again to FIG. 1, several wires 30 extend horizontally and connect to adjacent x-shaped posts 24 along the length of the structure 10. The wires 30 are attached to the posts 24 by a combination of traditional electrical insulators 60 and with non-conductive fasteners 22 so that the wires 30 can be connected to an appropriate electrical source (not illustrated) to convert the structure 10 into an electric structure.

The non-conductive fasteners 22 are shown in detail in FIGS. 11-14. Each of these non-conductive fasteners 22 is provided with a hollow sleeve 62 with a threaded bolt 35 for securing the fastener 22 to a leg 29 or 31 of the x-shaped posts 24 by first inserting the leg 29 or 31 through the hollow sleeve 62 and then causing the threaded bolt 35 to engage the leg 29 or 31 to hold the fastener 22 on the leg 29 or 31. Each non-conductive fastener 22 is provided with a pair of ears 64A and 64B that have horizontally aligned slots 66A and 66B for receiving a hollow non-conductive sleeve 68. Each non-conductive sleeve 68 is provided with a longitudinal slit 70 therein so that the non-conductive sleeve 68 can be slipped over a wire 30 and then inserted into the aligned slots 66A and 66B in the pair of ears 64A and 64B provided on the fastener 22. The longitudinal slit 70 is preferably inserted into the slots 66A and 66B first so that the wire 30 is captured within the slots 66A and 66B and held inside the hollow non-conductive sleeve 68.

As described and illustrated, the freestanding structure 10 is constructed of easily assembled pieces of tubing 12, 14, 15, and 16 and post feet 36 and member feet 56 secured together with connectors 18 and 20, couplings 21, fasteners 22, and wire 30 which require only the use of a couple of wrenches to assemble. This allows an owner to easily transport the materials needed to construct the structure 10 in the back of a truck or a trailer. And because the structure 10 is constructed in pieces, it can be disassembled, moved, and then reassembled as often as needed.

Although not illustrated, the feet 36 and 56 can be pretreated with an electrically non-conductive coating to make the structure 10 even less likely to serve as an electrical ground for lightening strikes, making the enclosed area safer for people or livestock that generally tend to congregate at the structure when a storm approaches.

Further, although not specifically illustrated, by making only slight modifications to the horizontal members 28, such as sealing both ends of the hollow pieces of square tubing 15 forming the horizontal members 28 and adding water or chemical nozzles at both ends, the horizontal members 28 of the structure 10 can be used as a conduit for water. By also adding sprinkler heads, the structure 10 can additionally be used as a sprinkler system. And with similar minor modifications, the horizontal members 28 can be used as conduit for lighting, cameras, security system wiring, fiber optics, network cabling, electrical wiring, monitors, sensors, radio frequency identification devices, solar panels, etc.

And as shown in FIGS. 1 and 2 the upper portion of each x-shaped connector 18 and posts 24 form a valley 72 that opens upward. Without any modifications to the structure 10, these valleys 72 can be employed to support a water hose (not illustrated) or other similar items off of the ground by laying the items on top of the x-shaped connector 18.

Figure 17:
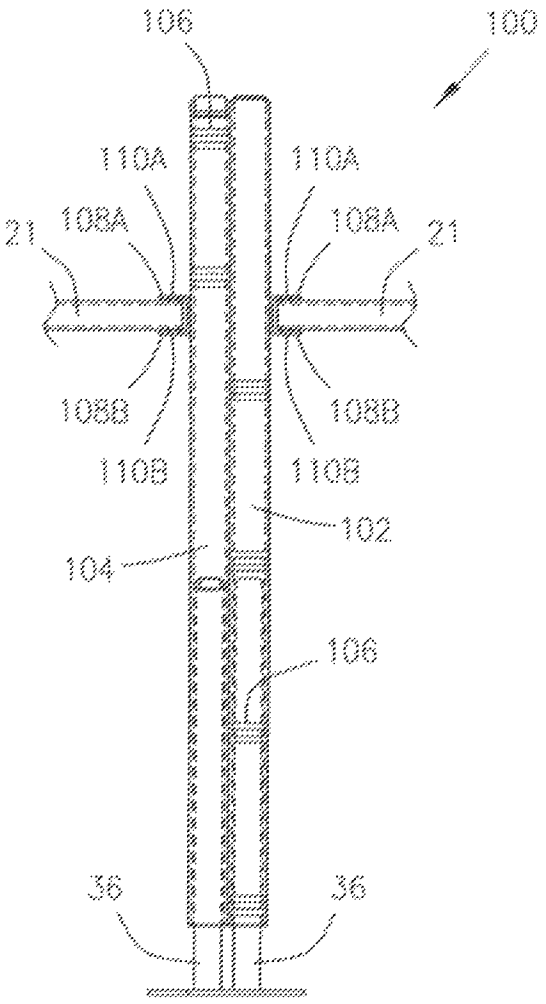
FIG. 17 is side view of the alternate x-shaped post of FIG. 16 taken along line 17-17.
Figure 16:
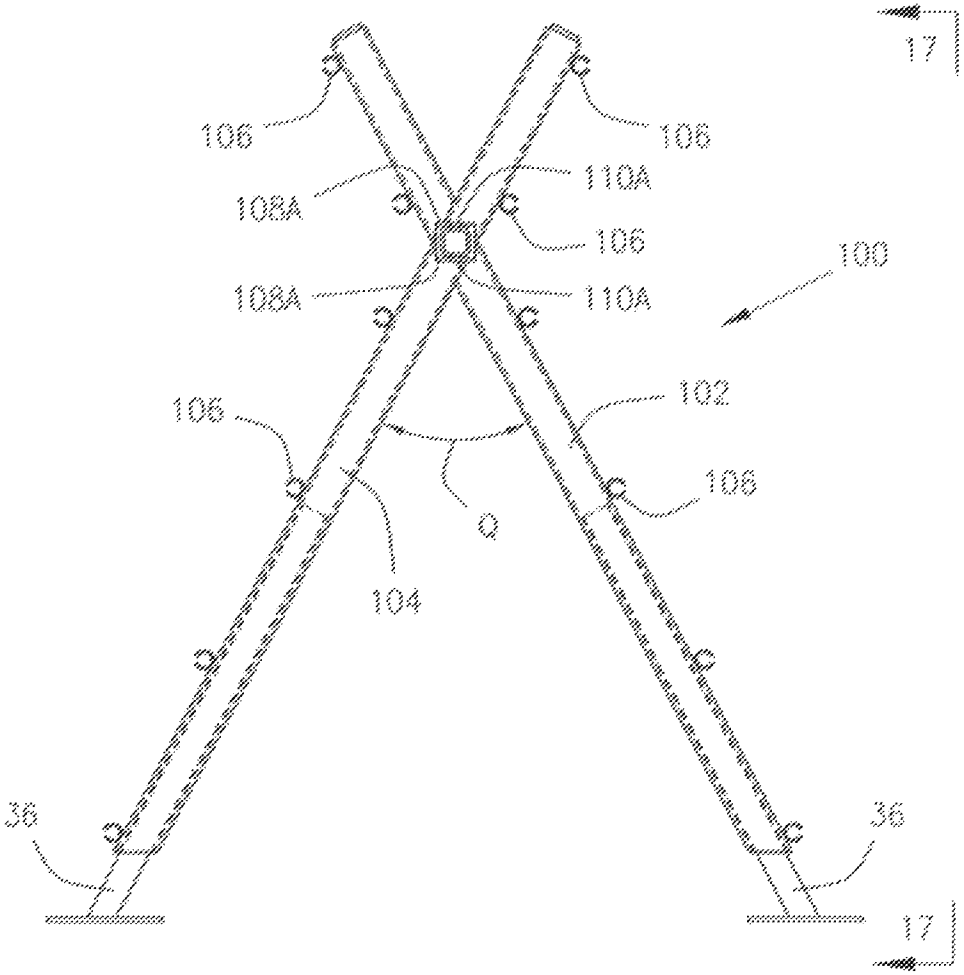
FIG. 16 is an end view similar to FIG. 2 showing an alternate embodiment x-shaped post that may be used with the invention instead of the x-shaped post illustrated in FIG. 2.

Referring now to FIGS. 16 and 17, there is illustrated an alternate embodiment x-shaped post 100 that is used in association with the invention 10 instead of the x-shaped posts 24. The two tubes 102 and 104 form the legs of the alternate x-shaped post 100. The two legs 102 and 104 are welded or otherwise secured together at approximately a 55 degree angle (Angle Q). Each of the alternate x-shaped post's legs 102 and 104 is provided with an adjustable length foot 36.

Each of the alternate x-shaped post legs 102 and 104 is provided with a plurality of c-shaped receivers 106 secured along the length of the tubes 102 and 104. The c-shaped receivers 106 are preferably welded to the tubes 102 and 104. The c-shaped receivers 106 are designed for receiving the non-conductive hollow sleeve 68 and wire 30 therein, as previously described for the fasteners 22.

Also, a pair of ears 108A and 108B are secured to the each tube, preferably by welding. Each ear 108A and 108B is provided with a bolt opening 110A and 110B there through so that the bolt openings 110A and 110B provided in each pair of ears 108A and 108B are aligned and serve to replace the ears 44A and 44B as a means of attaching the coupler 21 to the alternate x-shaped post legs 102 and 104. Together the ears 108A and 108B of the alternate x-shaped post 100, the bolt 35 that movably attaches the coupler 21 to the ears 108A and 108B, and the coupler 21 collectively form a universal joint. The universal joints then secure the horizontal members 28 between adjacent alternate x-shaped posts 100, in a manner similar to that previously described and illustrated in FIGS. 1, 7, and 8 in association with the x-shaped posts 24.

Figure 18:
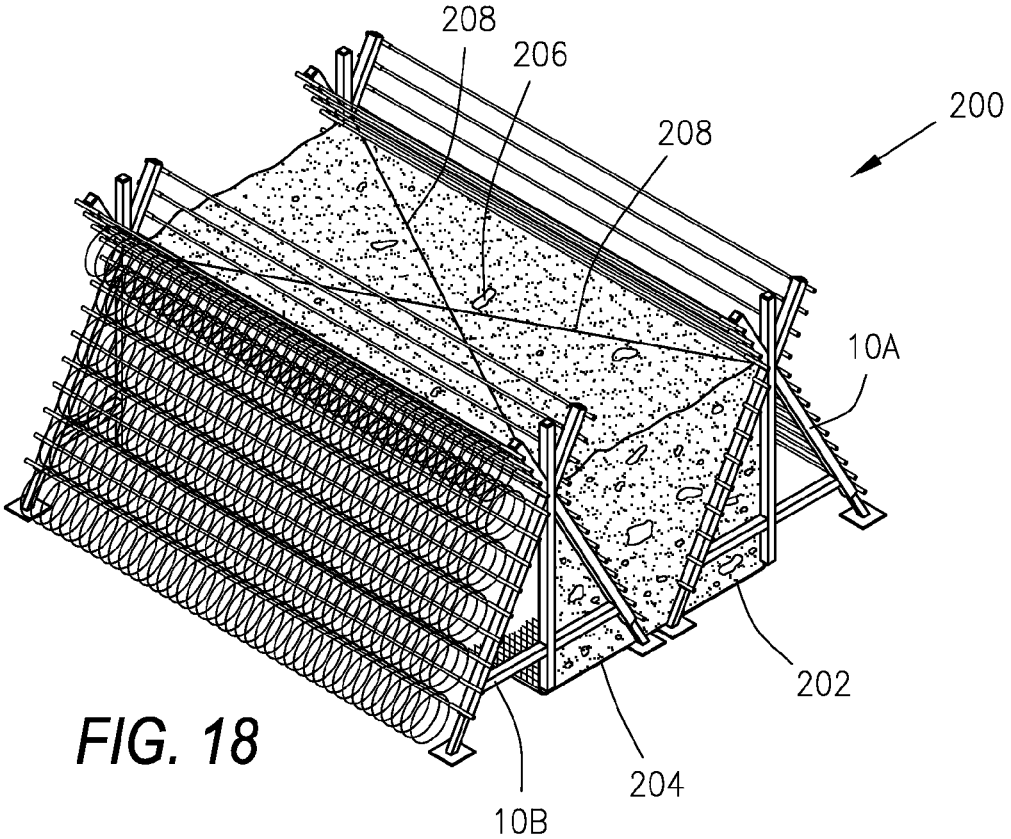
FIG. 18 is a single section of a freestanding force protection system that has been constructed to form a barrier in the form of a perimeter security barrier or wall.

Referring now to FIG. 18, there is illustrated a section of a force protection or barrier wall 200 that is constructed in accordance with a preferred embodiment of the present invention. FIGS. 19-24 illustrate various uses of the barrier wall 200. The barrier wall 200 is constructed by using at least one freestanding structure 10A and 10B arranged in parallel orientation with the addition of retaining members 202 attached to and located between each section of the two parallel structures 10A and 10B. The retaining members 202 are located between the structures 10A and 10B and attach to each of the two freestanding structures 10A and 10B so as to form a containment structure 204 within each section of the barrier wall 200. Each containment structure 204 is U-shaped when viewed in cross section. The structures 10A and 10B preferably constructed employing the previously described alternate x-shaped posts 100.

A desired fill material 206 is then added within the containment structure 204 such that the combination of the two structures and filled containment structure becomes the barrier wall 200.

Figure 19:
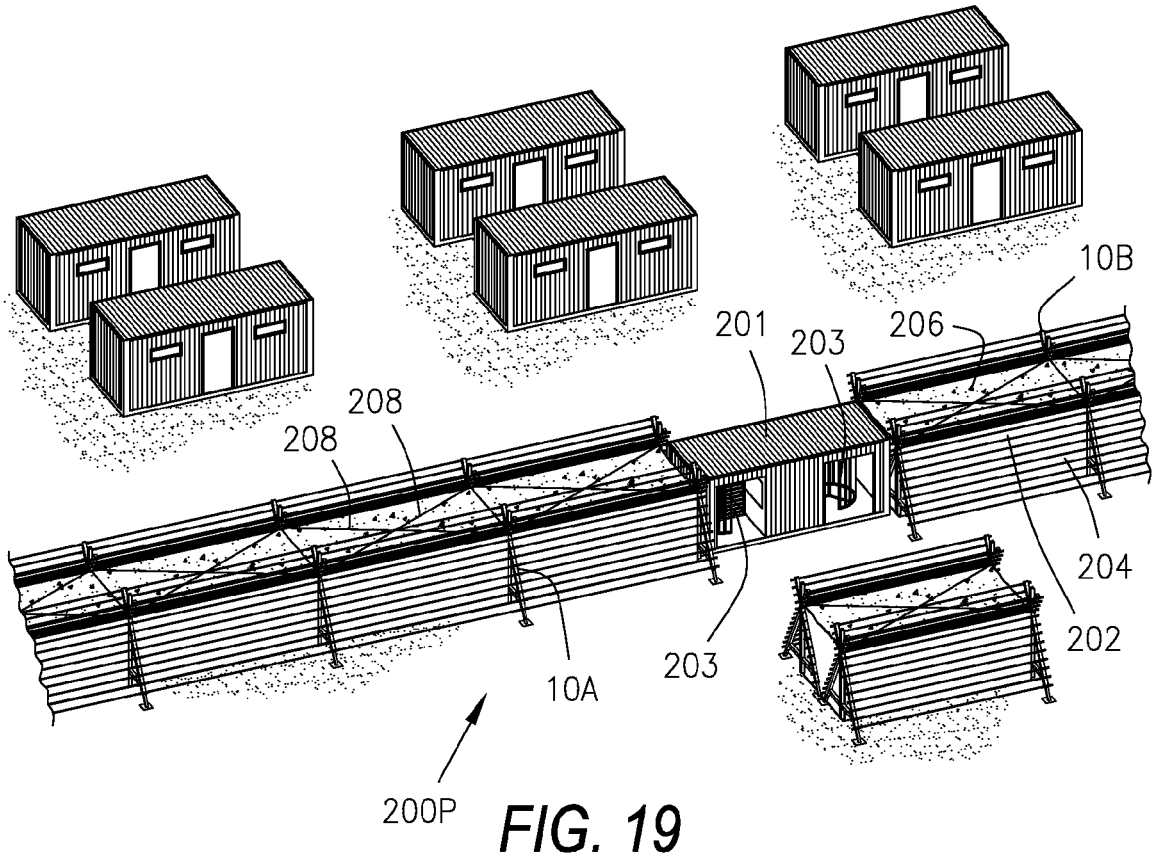
FIG. 19 shows several sections of the freestanding force protection system of FIG. 18 being used to construct a perimeter barrier designed to secure an area containing buildings. This installation includes one section of the system that is provided with turn stiles for admission of foot traffic into the secured area and a separate section of the system provided external to the section containing the turn stiles as a protective barrier for the turn stiles section.
Figure 20:
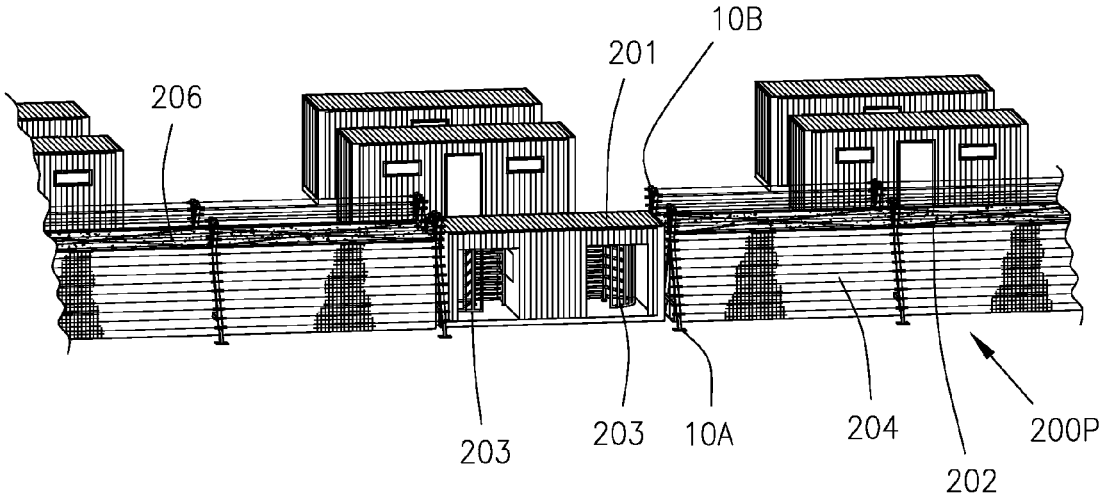
FIG. 20 is an enlarged view of the turn stiles section of the system of FIG. 19.
Figure 21:
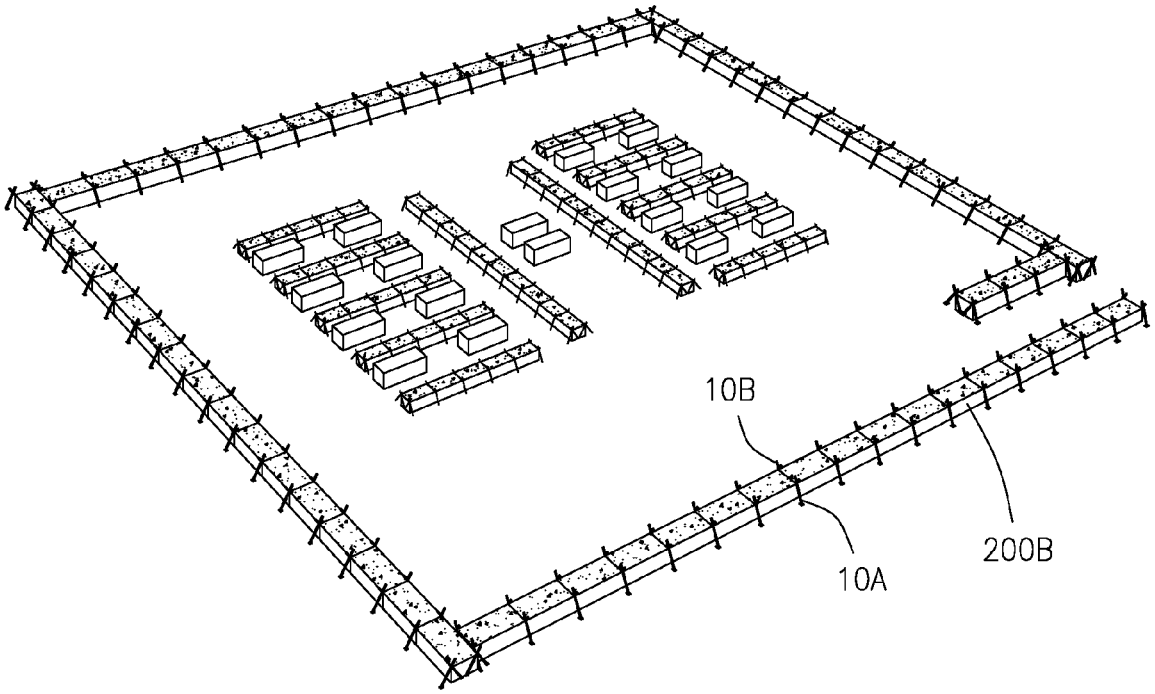
FIG. 21 is an aerial view showing an area secured by a perimeter freestanding force protection barrier constructed of the system of FIG. 18.
Figure 22:
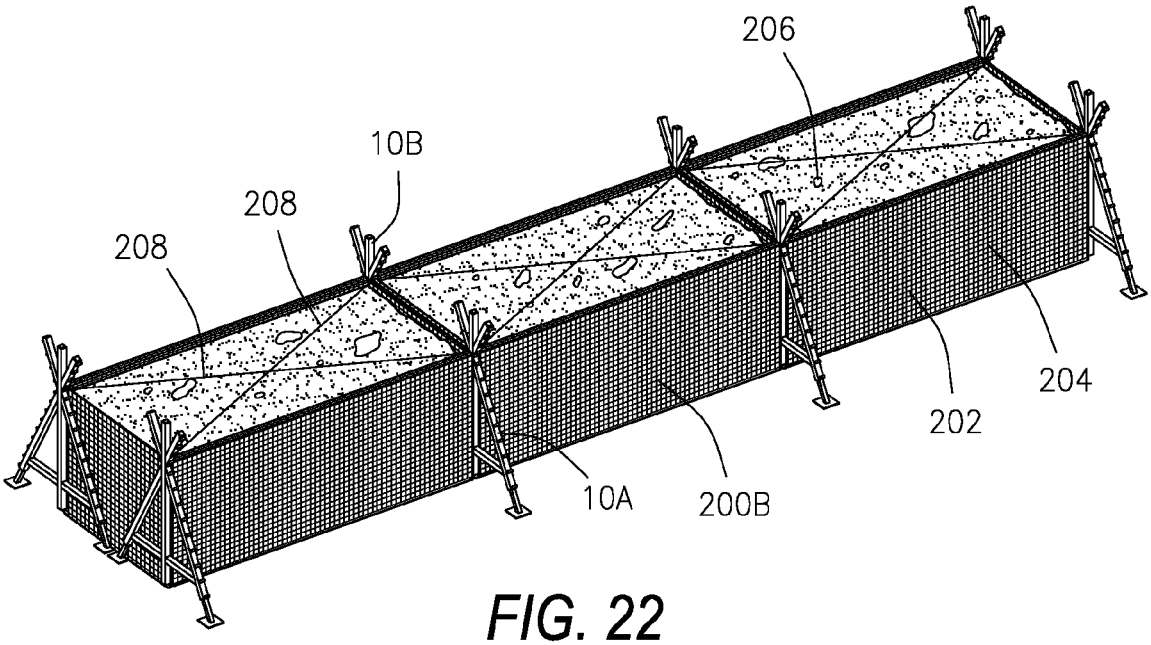
FIG. 22 is an enlarged section of the freestanding force protection system of FIG. 21 showing cross bracing that may be employed between the two freestanding units employed to construct the system.
Figure 23:
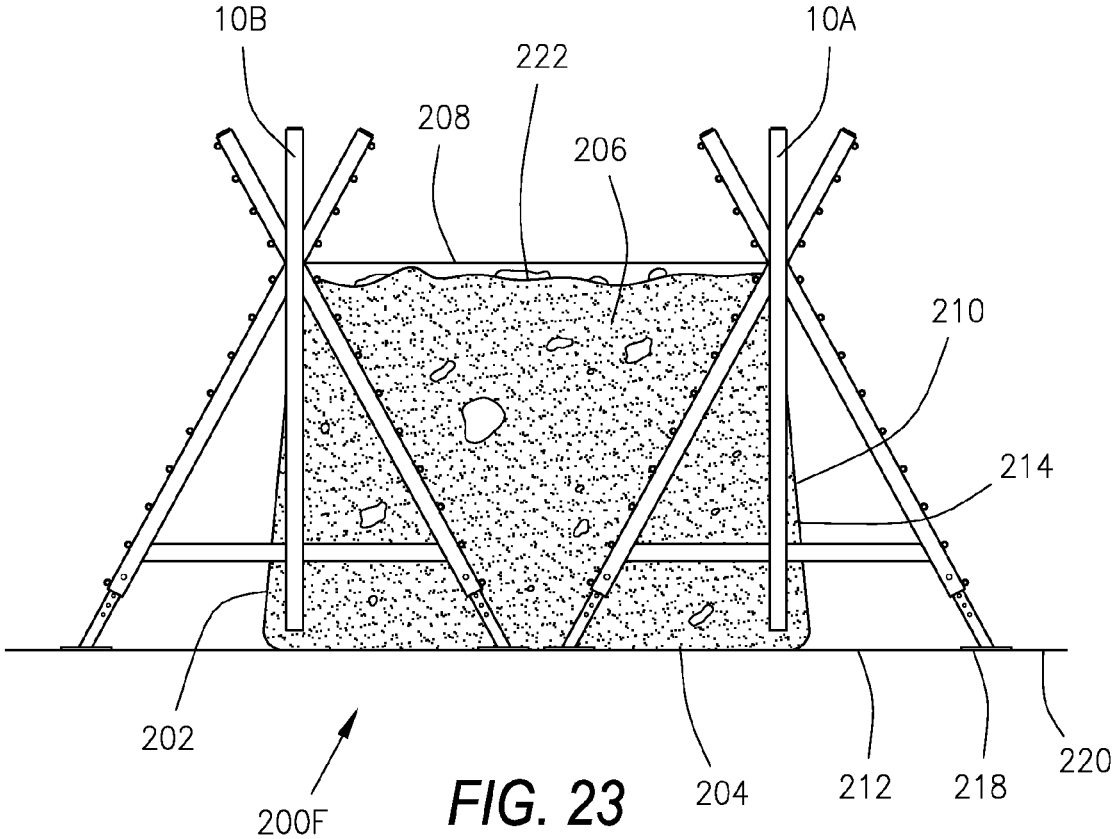
FIG. 23 is a cross sectional view of the freestanding force protection system of FIG. 22 shown with water being retained on one side of the system.
Figure 24:
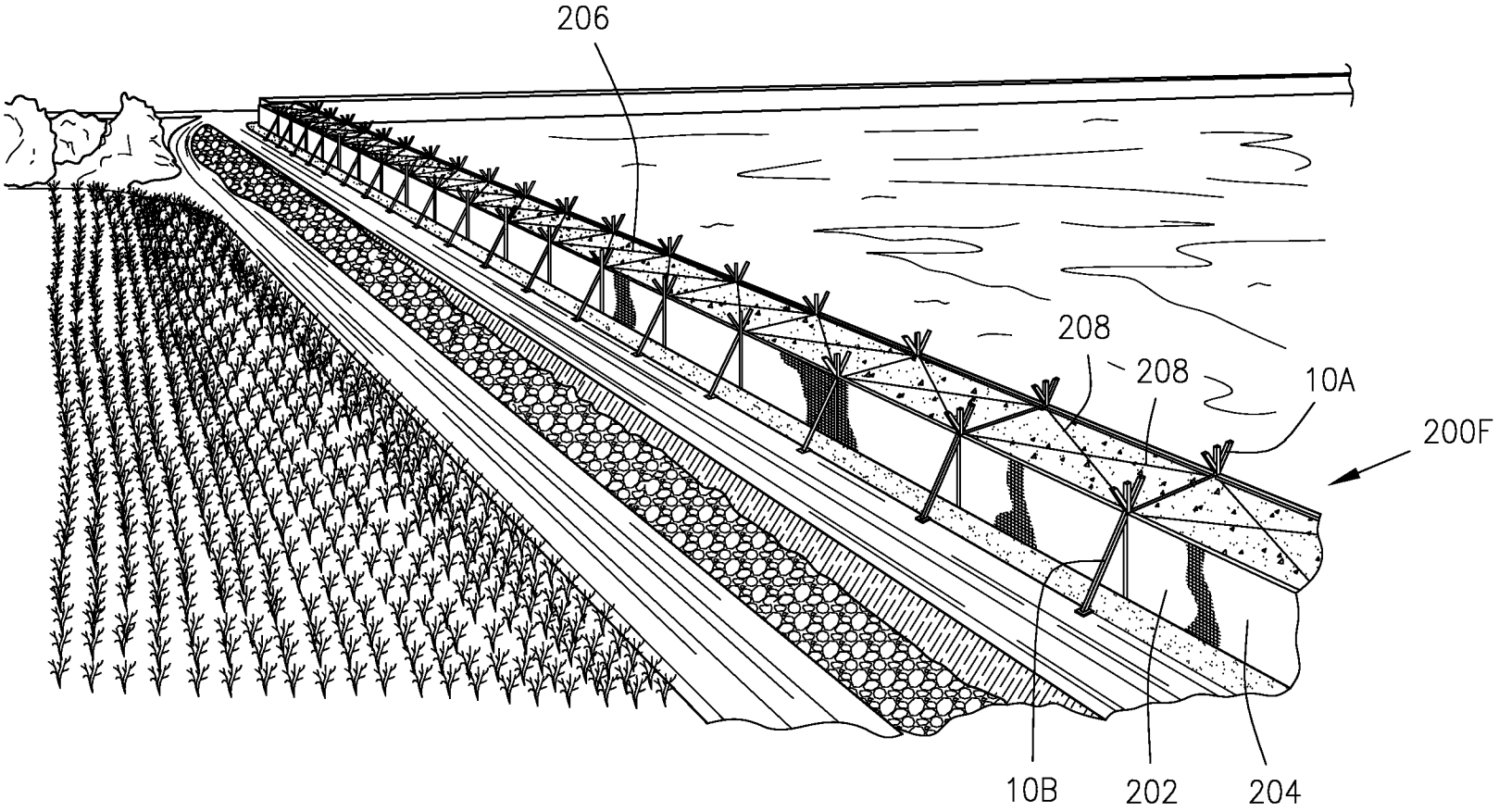
FIG. 24 is an aerial view of the freestanding force protection system of FIG. 23 showing a typical installation for retaining water using the system.

The barrier wall 200 thus formed can be used to prevent the passage of various things through the barrier wall 200. As illustrated in FIGS. 19-20, the barrier wall 200 can be used as a perimeter security wall 200P to prevent the passage of people or vehicles through the wall 200P. In this type of installation, it may be desirable to include a special pedestrian section 201 within the wall 200P that includes one or more doors, gates or turn stiles 203 to allow the controlled passage of foot traffic through the security wall 200P so that people can move into and out of an enclosed area. Or, as illustrated in FIGS. 21 and 22, the barrier wall 200 can be used as a blast wall 200B to prevent the barrier wall 200 from being breached and to prevent projectiles and blast debris or wind and waves from penetrating the barrier wall 200. As illustrated in FIGS. 23 and 24, the barrier wall 200 can also be used as a flood wall 200F to prevent the passage of water, liquid spills, or waves.

Regardless of the use to be made of the barrier wall 200, the basic infrastructure for the walls 200P, 200B and 200F is the same: at least one x-shaped freestanding structures 10A and 10B deployed in a parallel arrangement to form a frame for holding a retaining member 202 that is a giant u-shaped hammock or U-shaped containment structure 204 capable of being filled with sand or other fill material 206 or large containment sand bags to form a force protection barrier wall 200.

Figure 25:
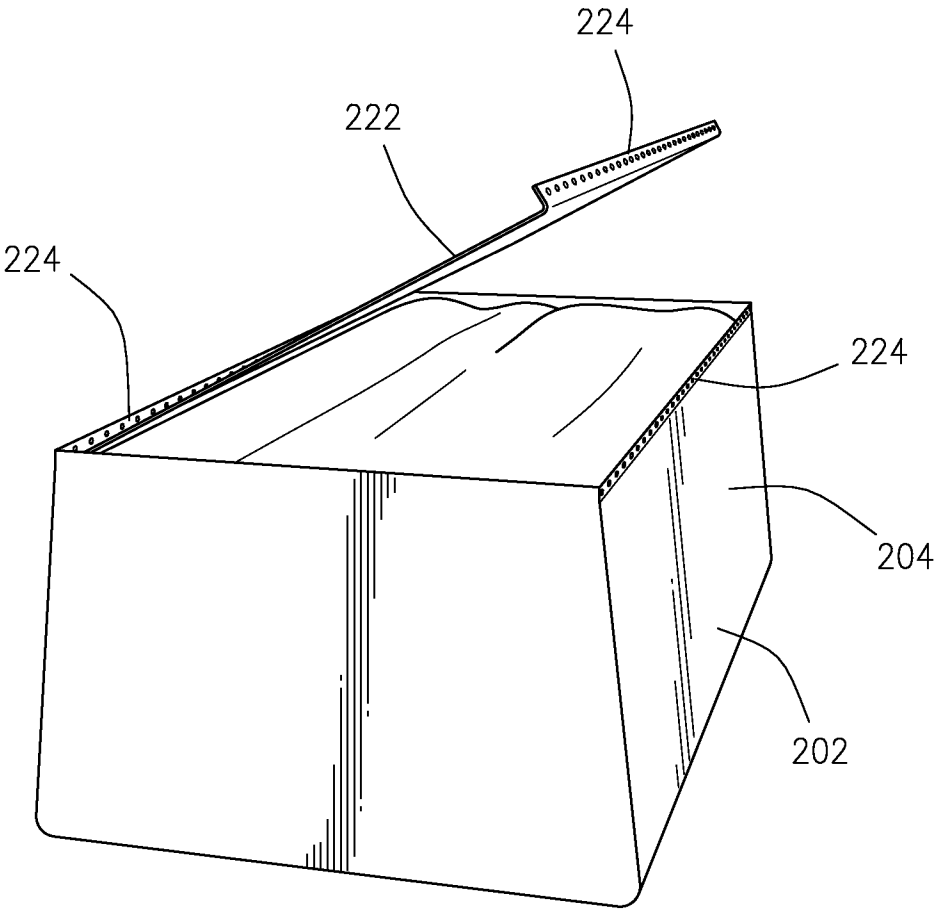
FIG. 25 is a perspective view of one giant containment structure that is shown without the supporting structures and shown with the top flap open on the containment structure.
Figure 26:
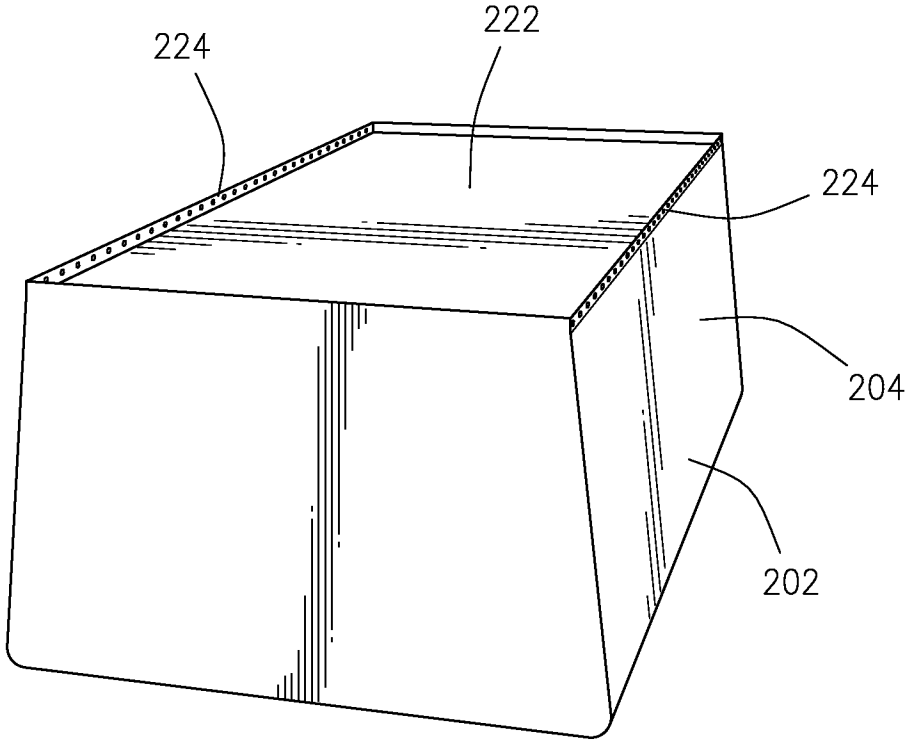
FIG. 26 is the giant containment structure of FIG. 25 shown with the top flap secured in a closed position on the containment structure.

The retaining member 202 may be made of various types of material having different porosities, different absorptive or adsorptive properties, different layers and shapes and different types of gussets so as to expand to touch adjacent retaining members 202. For example, the retaining member 202 may be made of PVC, burlap, other fibers or screens. The retaining member 202 is to form giant containment structures 204 or sandbags that are expected to contain fill material 206 that is sand, soil and rock or other suitable materials available in the local terrain. FIGS. 25 and 26 show a typical retaining member 202 in the form of a giant containment structure 204 that could be used for this purpose. As illustrated, the retaining member 202 is provided with grommets 224, Velcro® flaps (not illustrated), or other suitable attachment means to be able to attach the retaining member 202 to the X-shaped posts 24 of the two freestanding structures or support structures 10A and 10B or and to the horizontal members 28 of those structures or support structures 10A and 10B using cable ties (not illustrated), Velcro® or other suitable fastening means.

Figure 27:
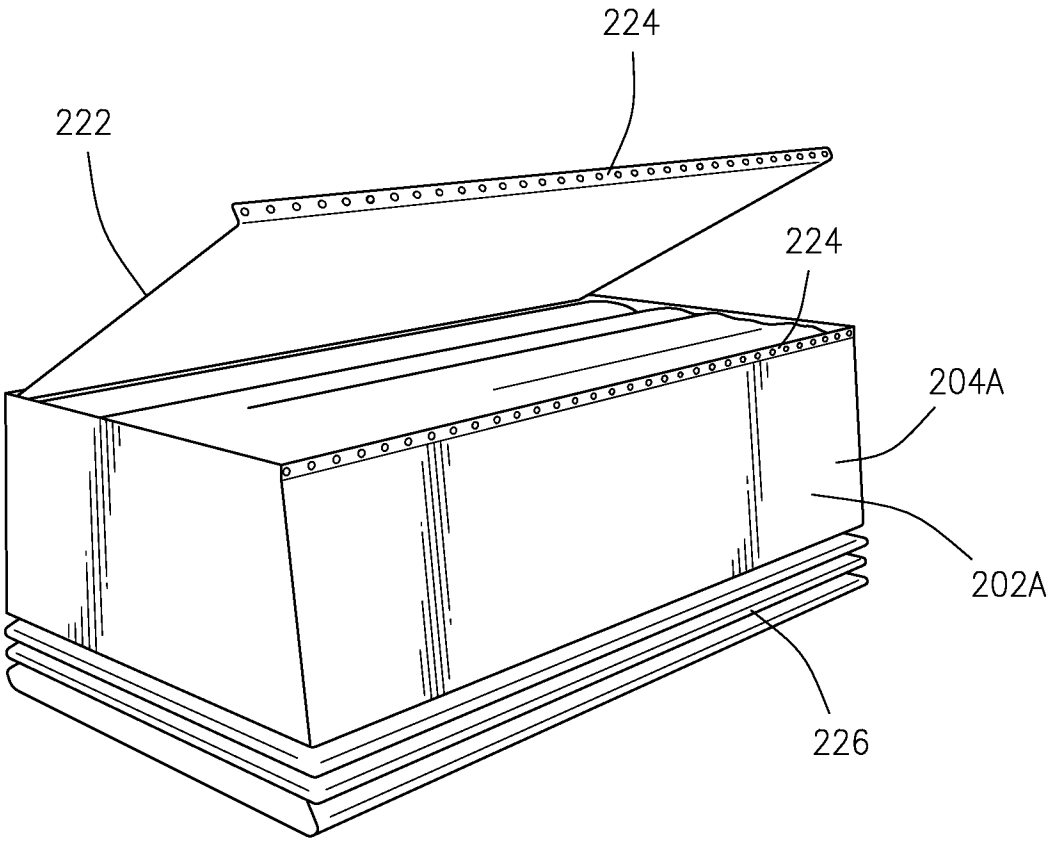
FIG. 27 is a perspective view of an alternate giant containment structure that includes gussets which allow for expansion.

FIG. 27 shows an alternate retaining member 202A in the form of an alternate giant containment structure 204A. This structure 204A is provided with a plurality of gussets 226 that allow for expansion as fill material 206 is added. Although the gussets 226 are illustrated as being horizontally oriented, they are not so limited and may be vertically or diagonally disposed on the structure 204A.

Also, the two parallel freestanding x-shaped structures or support structures 10A and 10B may need to be secured together in parallel arrangement with connecting cables or straps to prevent the two structures or support structures 10A and 10B from moving away from each other as the retaining member 202 is filled with the desired fill material 206.

The various containment structures 204 formed from the retaining members 202 are provided with gussets, folds, or extra fabric that allow the containment structures 204 to expand downwardly and outwardly on their ends and press together with adjacent containment structures 204 sufficiently to seal between the ends of the containment structures 204 of adjacent sections of the barrier wall 200 and thereby prevent liquid from flowing there between.

Alternately instead of using loose materials for the fill material 206, individual giant or small filled sandbags may be used for the fill material 206 to provide more resistance to erosion and to provide ballistics self-healing properties. Although not specifically illustrated, cement cloth may be additionally used to fortify external surfaces or to provide patches to damaged areas.

If the barrier wall 200 is to employed to retain water or other liquids, may be desirable to employ a liquid impervious layer 210 such as an acrylic or plastic membrane layer 210 that is added external to the retaining member 202 on the side of the barrier wall 200 that will be in contact with the liquid. The additional acrylic or plastic membrane layer 210 will attach by grommets (not illustrated), Velcro®, or other suitable fastening means provided in the membrane layer 210 to the top of what will be the wet side of the support structure 10A of the barrier wall 200 of the two free standing structures or support structures 10A and 10B that form the barrier wall 200. The membrane layer 210 would have several feet of extra length at its bottom forming a bottom ground flap or skirt 212 that would be anchored under the outward facing feet 36 of the proximal structure or support structure 10A of the barrier wall 200. Once in place, the membrane layer 210 would be arranged in an "L" shaped configuration, with an upper vertical portion 214 of the membrane layer 210 secured by its grommets to the top 216 of the proximal structure or support structure 10A and with a lower horizontal portion 218 deployed horizontally on the ground 220 and secured under the outward facing feet 26 of the proximal structure or support structure 10A.

Although not illustrated, in some installations, it may be desirable to employ specialized spill containment absorptive or adsorptive materials instead of or in addition to the fill or membrane layer 210, depending on the type of containment that is needed.

The desired fill material 206 may be dirt, sand, rock or other material or even large or small sand bags, depending on the materials that are available and the desired use of the resulting barrier wall 200. Hydraulic lift dump trucks or front-end loaders may be used to quickly fill the containment structures 204. Each containment structure 204 will be optionally provided with at least one top flap 222, as illustrated in FIG. 23 and in FIGS. 25-27, that will be used to seal the open tops of the containment structures 204 once they are filled with fill material 206. The top flaps 222 will have grommets 224, Velcro® or other suitable fastening means that can be used to seal the filled containment structures 204.

Once use is completed, the giant containment structures 204 or 204A will be untied or cut loose from the two x-shaped structures or support structures 10A and 10B, and the structures or support structures 10A and 10B will be unbolted, disassembled, and removed. The containment structures 204 and associated fill material 206 may be left in place, trucked away or spread out using a bulldozer, as desired.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A portable barrier wall for preventing the passage of people, vehicles, projectiles, blast debris, liquids or wind comprising:

at least two x-shaped freestanding support structures, said x-shaped freestanding support structures supporting retaining members that collectively form a containment structure, each said x-shaped freestanding support structure formed by two legs that lie in a vertical plane, said two legs crossing each other to form the x-shaped freestanding support structure, each leg is provided with a foot on a lower end of the leg that rests upon a to surface of the ground and with an opposite upper end that extends upward away from the ground, and fill material contained within each retaining member, means for sealing the fill material within each retaining member.

2. A portable barrier wall according to claim 1 further comprising:

a liquid impervious layer that is placed external to each of the retaining members on a side of the containment structure that will be in contact with liquid that is to be retained by the containment structure, and said liquid impervious layer being of sufficient length to anchor under the feet of the x-shaped freestanding support structures.

3. A portable barrier wall according to claim 1 further comprising:

at least one segment provided in the containment structure that includes a passageway for controlled passage of people through the containment structure.

4. A portable barrier wall according to claim 1 further comprising:

said at least two x-shaped freestanding support structures arranged in parallel orientation to form a frame for holding said retaining members, and said retaining members provided attached to and located between adjacent x-shaped freestanding support structures to form said retaining members into a U-shape between adjacent x-shaped freestanding support structures to form segments of the containment structure.

5. A portable barrier wall according to claim 4 further comprising:

connecting means attached to adjacent x-shaped freestanding support structures to secure them together.

6. A portable barrier wall according to claim 1 further comprising:

at least one electronic device attached to said x-shaped freestanding support structures to monitor and protect against compromise of the containment structure.

* * * * *